US010876538B2

(12) United States Patent
Nissler et al.

(10) Patent No.: US 10,876,538 B2
(45) Date of Patent: Dec. 29, 2020

(54) ASSEMBLY HAVING TWO COMPRESSORS, METHOD FOR RETROFITTING

(71) Applicant: Siemens Aktiengesellschaft, Munich (DE)

(72) Inventors: Joachim Nissler, Duisburg (DE); Hans Schulz, Oberhausen (DE)

(73) Assignee: SIEMENS AKTIENGESELLSCHAFT, Munich (DE)

( * ) Notice: Subject to any disclaimer, the term of this patent is extended or adjusted under 35 U.S.C. 154(b) by 381 days.

(21) Appl. No.: 15/554,545

(22) PCT Filed: Feb. 24, 2016

(86) PCT No.: PCT/EP2016/053826
§ 371 (c)(1),
(2) Date: Aug. 30, 2017

(87) PCT Pub. No.: WO2016/142171
PCT Pub. Date: Sep. 15, 2016

(65) Prior Publication Data

US 2018/0073512 A1 Mar. 15, 2018

(30) Foreign Application Priority Data

Mar. 12, 2015 (DE) ..... 10 2015 204 466

(51) Int. Cl.
*F04D 27/02* (2006.01)
*F04D 19/02* (2006.01)
(Continued)

(52) U.S. Cl.
CPC ..... *F04D 27/0215* (2013.01); *F04D 17/12* (2013.01); *F04D 19/02* (2013.01);
(Continued)

(58) Field of Classification Search
CPC ..... F04D 25/16; F04D 25/163; F04D 17/12; F04D 27/0215; F04D 19/02;
(Continued)

(56) References Cited

U.S. PATENT DOCUMENTS 3,747,626 A * 7/1973 Valentino ..... F16K 15/18 137/102
5,461,861 A 10/1995 Wenzel
(Continued)

FOREIGN PATENT DOCUMENTS

CN 1087402 A 6/1994
CN 102979751 A 3/2013
(Continued)

OTHER PUBLICATIONS

Gas turbine—Wikipedia, the free encyclopedia (Year: 2014).*
(Continued)

*Primary Examiner* — Kenneth J Hansen
*Assistant Examiner* — David N Brandt

(57) ABSTRACT

An assembly having a first compressor train and a second compressor train for compressing a process fluid, wherein the first compressor train has a first drive and a first compressor, wherein the second compressor train has a second drive and a second compressor, wherein the first compressor train is not mechanically coupled to rotating parts of the second compressor train for transmission of torque, wherein the two compressors of the different compressor trains are directly connected to each other fluidically by a connecting fluid line such that the first compressor is arranged upstream of the second compressor. The first compressor compresses at a pressure ratio between 1.1 and 1.6 before the process fluid is fed to the second compressor.

18 Claims, 7 Drawing Sheets

(51) Int. Cl.

| | |
|---|---|
| ***F04D 17/12*** | (2006.01) |
| ***F04D 19/00*** | (2006.01) |
| ***F04D 29/70*** | (2006.01) |
| ***F04D 25/16*** | (2006.01) |
| ***F04D 29/60*** | (2006.01) |
| *F04D 29/58* | (2006.01) |
| *F04D 25/06* | (2006.01) |

(52) U.S. Cl.
CPC ..... *F04D 25/16* (2013.01); *F04D 25/163* (2013.01); *F04D 27/0253* (2013.01); *F04D 27/0292* (2013.01); *F04D 29/601* (2013.01); *F04D 29/701* (2013.01); *F04D 19/00* (2013.01); *F04D 25/06* (2013.01); *F04D 29/5826* (2013.01); *F05D 2230/80* (2013.01)

(58) Field of Classification Search
CPC ..... F04D 27/0292; F04D 29/601; F04D 27/0207; F04D 17/105; F04D 29/701; F04D 27/0253; F04D 29/5826; F04D 25/06; F04D 25/04; F04D 19/00; F05D 2230/80
See application file for complete search history.

(56) References Cited

U.S. PATENT DOCUMENTS

| | | | | |
|---|---|---|---|---|
| 5,503,523 | A | 4/1996 | Prumper | |
| 5,553,448 | A * | 9/1996 | Farrell | F02C 3/10 29/401.1 |
| 6,308,512 | B1 * | 10/2001 | Kopko | F02C 3/36 60/726 |
| 6,397,621 | B1 * | 6/2002 | Reynaud | F04D 17/122 62/238.4 |
| 8,323,000 | B2 * | 12/2012 | Mirsky | F01D 15/08 417/295 |
| 9,217,423 | B2 * | 12/2015 | Chen | F03G 7/06 |
| 10,385,861 | B2 * | 8/2019 | Degenstein | F25J 3/04303 |
| 2002/0037225 | A1 | 3/2002 | Choi et al. | |
| 2008/0078395 | A1 * | 4/2008 | Ho | A61M 16/208 128/205.24 |
| 2008/0264061 | A1 * | 10/2008 | Wickert | F04D 25/163 60/670 |
| 2009/0293502 | A1 * | 12/2009 | Vandor | F25J 1/004 62/45.1 |
| 2012/0222549 | A1 * | 9/2012 | Vermeer | F04D 27/02 95/41 |
| 2012/0260693 | A1 * | 10/2012 | DeMore | F04D 25/16 62/644 |
| 2015/0211539 | A1 * | 7/2015 | Wang | F25J 3/04018 415/1 |
| 2015/0337845 | A1 | 11/2015 | Wenzel | |

FOREIGN PATENT DOCUMENTS

| | | | |
|---|---|---|---|
| DE | 69109173 | T2 | 8/1995 |
| DE | 102006028654 | A1 | 12/2007 |
| DE | 102009024775 | A1 | 12/2010 |
| DE | 202012101190 | U1 | 4/2012 |
| DE | 102013201482 | B3 | 10/2013 |
| DE | 102013006109 | A1 | 10/2014 |
| DE | 102014107126 | A1 | 11/2015 |
| EP | 0811770 | A1 | 12/1977 |
| GB | 1551454 | A | 8/1979 |
| RU | 2082022 | C1 | 6/1997 |
| RU | 2255271 | C2 | 6/2005 |
| WO | 03040567 | A1 | 5/2003 |
| WO | 2009095097 | A1 | 8/2009 |

OTHER PUBLICATIONS

RU search report dated Aug. 9, 2018, for corresponding RU patent application No. 2017134834/06.
CN search report from CN Office Action dated Sep. 13, 2018, for corresponding CN patent application No. 201680015360.6.
IPRP (PCT/IPEA/416 and 409) dated Mar. 1, 2017, for PCT/EP2016/053826.
International Search Report dated Jun. 1, 2016, for PCT/EP2016/053826.
DE Search Report dated Dec. 15, 2015, for DE patent application No. 102015204466.1.

* cited by examiner

ASSEMBLY HAVING TWO COMPRESSORS, METHOD FOR RETROFITTING

CROSS REFERENCE TO RELATED APPLICATIONS

This application is the US National Stage of International Application No. PCT/EP2016/053826 filed Feb. 24, 2016, and claims the benefit thereof. The International Application claims the benefit of German Application No. DE 102015204466.1 filed Mar. 12, 2015. All of the applications are incorporated by reference herein in their entirety.

FIELD OF INVENTION

The invention relates to an arrangement having a first compressor train and a second compressor train for compressing a process fluid, wherein the first compressor train comprises a first drive and a first compressor, wherein the second compressor train comprises a second drive and a second compressor, wherein the first compressor train is not mechanically coupled in torque-transmitting fashion to rotating parts of the second compressor train, wherein the two compressors of the different compressor trains are directly connected in fluid-conducting fashion to one another by means of a connecting fluid line, in such a way that the first compressor is arranged upstream of the second compressor. The invention also relates to a method for retrofitting a first compressor to an existing installation comprising a second compressor in order, during the course of the retrofitting, to obtain an arrangement according to the invention from an existing installation.

BACKGROUND OF INVENTION

The invention is concerned substantially with increasing the power of compressor installations. Two crucial parameters with regard to the power are the volume flow and the pressure ratio of outlet pressure to inlet pressure of a corresponding compressor installation. In order, in the case of a predefined number of compressor stages, to further increase the power of the compressor installation, there are substantially two available possibilities: increasing the diameter of blade rings or impellers, or increasing the rotational speed. These two design options have been substantially exhausted because the available materials have already reached the limits of their strength characteristic values and accordingly cannot, in terms of forces, withstand any greater circumferential speeds or diameters. Larger diameters furthermore give rise to additional problems with regard to the manufacturing of the rotors, and further challenges with regard to the rotor dynamics.

A field of use of the invention lies in the field of air compressors in the form of geared compressors, the intake by which occurs substantially under atmospheric conditions—possibly with the interposition of a filter, resulting in a pressure below atmospheric pressure at the compressor inlet port—and which compress the intake volume flow to a final pressure of approximately 3 to 200 bar by means of multiple radial compressor stages. A geared compressor is substantially a—relatively large—gearing housing, on the outside of which there are mounted various spiral housings in which the impellers of the radial compressors are driven by gearing pinions. Inter-cooling may be provided in each case between the individual compression stages. The largest diameters of impellers of such radial compressor stages have hitherto been below two meters and, owing to the problems already indicated above, have been increased only with great obstacles in terms of construction, using expensive materials and special manufacturing techniques.

Various multi-stage compression arrangements are already known from the documents US 2012/260693 A1, DE 20 2012 101190 U1, WO 03/040567 A1, GB 1 551 454 A, EP 0 811 770 A1, WO 2009/095097 A1.

SUMMARY OF INVENTION

Proceeding from the problems discussed above, it is an object of the invention to provide a compressor installation which provides higher power with relatively little outlay. Furthermore, it is an object of the invention to provide a method for retrofitting existing compressor installations such that the respectively retrofitted compressor installation provides higher power, in particular a greater volume flow. Said two objects should not imperatively be associated with the load on components or materials moving closer to corresponding limit values, or with the need to use more expensive materials.

To achieve the object according to the invention, an arrangement of the type mentioned in the introduction having the additional features of the independent claim is proposed. The invention furthermore proposes a method for retrofitting an existing installation as per the method claim. The subclaims with respective back-references encompass advantageous refinements of the invention.

A concept which is essential to the invention consists in increasing the power of a compressor installation such that the process fluid taken in by the second compressor is increased in pressure by a factor of 1.1 to 1.6 upstream of the inflow. This type of precompression or supercharging of the second compressor can—in the case of a substantially unchanged pressure ratio of outlet pressure to inlet pressure of the overall installation—lead to a standard volume flow increase or mass flow increase of between 10% and 40% in relation to a non-supercharged arrangement. The outlay for supercharging according to the invention is relatively low here, because the pressure ratio of the first compressor is small. For such a pressure ratio, it is for example sufficient for a blower to be provided or retrofitted in the inflow to the second compressor, which blower, according to the invention, has a dedicated drive and can accordingly be operated substantially independently of the first compressor. The solution according to the invention is of particular interest as a retrofit solution for existing installations which are incorporated in a process which can be increased in productivity in particular by means of an increase of the volume flow.

An advantageous refinement provides that the second compressor compresses with a pressure ratio between 3 and 60. The ratio of the pressure ratios between the second compressor and the first compressor may advantageously amount to approximately between 2.3 and 56, and the second compressor particularly advantageously has a pressure ratio at least 3.8 times higher than that of the first compressor. For this reason, the first compressor can, owing to the type of construction, be produced at very much lower cost than the second compressor, and may be referred to as a fan (pressure ratio of 1 to 1.3) or blower (pressure ratio of 1.3 to 3.0).

The first drive belonging to the first compressor train may be in the form of either an electric motor, a steam turbine or a gas turbine. For maximum flexibility and lower investment outlay, it is particularly expedient to select an electric motor as first drive. The second drive may likewise be in the form of a turbine or in the form of an electric motor. If process steam is available, operation by means of a steam turbine is particularly advantageous. The first compressor may be in the form of an axial compressor or in the form of a radial compressor, wherein, owing to the low pressure ratio of the first compressor, the term "fan" or "blower" may also be used. Below, the expression "first compressor" will generally be used without regard to a possible pressure ratio of the first compressor, wherein, in the narrower sense, depending on the pressure ratio, said first compressor may be a fan or a blower. In the terminology of this patent application, the expression "first compressor" also encompasses the embodiment of said first compressor as a fan or blower.

A particularly advantageous refinement of the invention provides that the first compressor comprises at least two compressor stages and the first drive is arranged between a first group of compressor stages and a second group of compressor stages.

In the case of an embodiment of the first compressor as an at least two-channel, in particular dual-channel, radial compressor, wherein both radial impellers have in each case an axial intake side and an axial wheel disk side, it may be expedient if the wheel disk side of the first radial impeller faces axially toward the wheel disk side of the second radial impeller and the intake by the two radial impellers occurs axially from opposite directions. Here, the drive may either be arranged axially between the two wheel disk sides or may drive the two impellers axially on one side. The two impellers of the radial compressor may discharge flow into a common diffuser. The dual-channel configuration corresponds to a parallel arrangement of the radial impellers.

An expedient refinement of the invention provides that the arrangement has a filter upstream of the second compressor. Here, it may be expedient if the first compressor is arranged upstream of said filter and if the process fluid is conducted into the second compressor only after passing through the filter. Here, the intake by the first compressor would advantageously occur directly under atmospheric conditions without a filter, and in the case of retrofitting, the downstream installation would possibly need to be adapted to a slightly higher pressure in the filter and upstream of the second compressor in the intake line. Alternatively, the first compressor may also be provided between the filter and the second compressor, such that the process fluid is, downstream of the first compressor, conducted directly into the second compressor without passing through a filter. Here, it is expedient that the filter housing, in particular in the case of retrofitting, does not need to be designed for a slightly increased pressure.

Another advantageous refinement provides that at least the first compressor or the entire first compressor train is arranged in a housing of a filter.

Corresponding filters are often situated with their dedicated housing outside a machine case, such that, in the event of an expansion of a filter of said type, greater freedom in terms of construction exists around for example the first compressor or compressor train than within the machine case, where the second compressor train is arranged. This advantage is also obtained in the case of an arrangement of the first compressor upstream of the filter, as has already been described above.

The arrangement is particularly expediently equipped with a surging protection device. The surging protection device may be provided in particular for protecting the first compressor against a surging process of the second compressor. Owing to the very much greater pressure ratio of the second compressor, corresponding surging processes at said assembly are associated with relatively high potential for destruction. Said surging protection device may advantageously have a closing device which, in the event of surging, closes at least 80% of the flow cross section of the connecting fluid line between the first compressor and the second compressor. Said closing device may expediently have flaps which block the cross-sectional area of the connecting fluid line in the event of a backflow. It is particularly expedient for said flaps to be designed such that, in the event of a backflow movement of the process fluid in the direction of the first compressor, the aerodynamics of the flaps, driven by the backflowing process fluid, moves the flaps into a closing position. For a movement from the closing position back into the opening position, damping may be provided, such that the flaps do not open and close periodically with the surging shocks. It is particularly expedient for the flaps to be designed so as to be mounted so as to be rotatable or pivotable in each case about a spindle. Said spindles extend advantageously perpendicular to a longitudinal axis of the fluid-conducting connection and perpendicular to the main flow direction through the fluid-conducting connection. Said flaps are particularly advantageously arranged adjacent to one another in the manner of lamellae, such that, in an opening position of said flaps, the process fluid flows through the fluid line through a grate formed by the rotary spindles of the flaps. In a closing position, the intermediate spaces between the rotary spindle grates are closed by the louver-like or lamella-like flaps. Alternatively or in addition to the closing device of the surging protection device, it is expedient for a relief device to be provided which, in the event of surging of the first compressor and/or of the second compressor, relieves the connecting fluid line between the first compressor and the second compressor, or at least the section of the fluid line between the closing device and the second compressor, of pressure and/or pressure shocks by means of an opening into a pressure sink, for example the surroundings. Such a relief device and/or closing device is particularly expedient if the first compressor is an axial compressor, because the generally free-standing blades of an axial compressor are sensitive to pressure shocks from surging processes. In the case of a first compressor in the form of a radial compressor, it may be justifiable, in particular for cost reasons, to provide no surging protection device upstream of the second compressor, because a compressor in the form of a radial compressor can be designed to be adequately resilient.

What is particularly expedient is an embodiment of a surging protection device with a relief device which has a slide valve and which is mechanically connected to a closing device. Here, the slide valve may exhibit axial displaceability in a longitudinal direction of the connecting fluid line, which is displaced axially owing to a backflow of the process fluid differential force acting on the closing device, in such a way that a pressure-relieving opening in the connecting fluid line is realized owing to the thus open slide valve.

The arrangement according to the invention is particularly highly suitable for the retrofitting of a first compressor train to a second compressor train of an existing installation, such that an arrangement according to at least one above-described embodiment of the invention is realized. It is particularly expedient for the first compressor to be retrofitted to the existing second compressor, wherein the second compressor is aerodynamically modified such that the pressure ratio of the second compressor is reduced in relation to the state before the retrofitting. In this way, the overall arrangement composed of first compressor and second compressor realized as a result of retrofitting can have a greater volume flow than the second compressor alone, at the same time with an identical pressure ratio in relation to the atmosphere. In the retrofit situation, it is often the case that a substantially unchanged pressure ratio, or the same final pressure, is desired, along with a possibly increased volume flow, because the incorporation into the existing process demands the already previously specified final pressure from the overall compression.

An advantageous refinement of the invention provides that the arrangement according to the invention is a constituent part of a gas turbine, such that the second compressor is, with a compressor housing, a direct constituent part of the gas turbine. Here, it is expedient if the first compressor can be optionally incorporated into the flow path of the fresh-air intake, such that, for example, in a manner dependent on the ambient conditions, the first compressor can perform the function of a precompressor for the gas turbine.

A special refinement of this arrangement with first compressor that can be incorporated into the flow path provides a shut-off element, for example a flap and a bypass in addition to a direct intake of the second compressor past the first compressor. The first compressor is arranged in the bypass, such that the precompressor is utilized only when required (for example in the case of seasonal fluctuations) and the intake of the second compressor otherwise occurs directly through the opened flap. When the flap is open, an introduction guide apparatus of the precompressor can be closed, such that no uncontrolled bypass flow to the opened flap occurs.

An advantageous refinement of the invention provides that the first compressor has an inlet guide apparatus, which adapts the inlet cross section to the required intake capacity. The drive of the first compressor is particularly advantageously not regulated in a manner dependent on the setpoint volume flow, such that the regulation of the volume flow through the first compressor is performed, in the case of an approximately constant rotational speed, exclusively by means of the inlet guide apparatus.

BRIEF DESCRIPTION OF THE DRAWINGS

Below, the invention will be described in more detail on the basis of a number of exemplary embodiments with reference to drawings, in which.

DETAILED DESCRIPTION OF INVENTION

Figure 1:
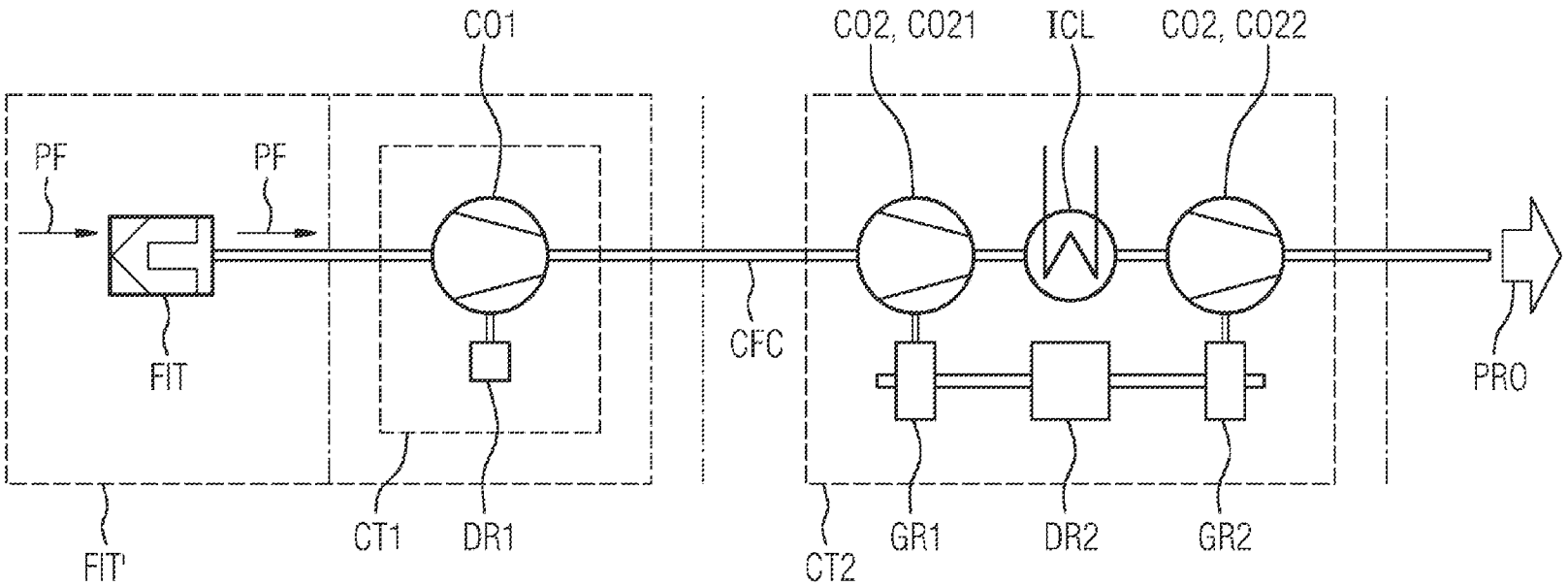
FIG. 1 shows a schematic process overview of an arrangement according to the invention.

An arrangement according to the invention having a first compressor train CT1 and a second compressor train CT2 is depicted in FIG. 1 in a schematic illustration in a plan view onto the longitudinal axis of the overall arrangement. A process fluid PF is taken in through a filter FIT, FIT' and, in a first compressor CO1, which is in the form of a blower, of a first compressor train CT1, said process fluid is raised to a higher pressure level. FIG. 1 shows two alternative embodiments of the filter FIT, FIT'. In a first possible embodiment, the filter FIT is situated in a housing which is separate from the first compressor train CT1. In the second embodiment, the filter FIT' is situated in a common housing with the first compressor train CT1.

After emerging from the first compressor CO1 of the first compressor train CT1, the process fluid PF passes into a connecting fluid line CFC situated downstream and, further downstream, to a second compressor train CT2. The second compressor train CT2 has a second compressor CO2 which is in the form of a geared compressor, such that a first compressor stage CO21 of the second compressor CO2 is driven by means of a first gearing GR1 and a second compressor stage CO22, situated downstream, of the second compressor CO2 is driven by means of a second gearing GR2. The first gearing GR1 and the second gearing GR2 are driven by means of a second drive DR2, wherein, in a manner which is not illustrated, the two gearings GR1, GR2 are constituent parts of a common gearing of the geared compressor.

Such geared compressors are basically known. These are gearing housings—which are relatively large—on the outside of which spiral housings of the individual compressor stages are flange-mounted. In general, in the gearing, there is arranged a large gear which is driven by a common drive for the individual compressor stages. Normally, said drive is, outside the gearing housing, connected in torque-transmitting fashion to the gearing housing by means of a clutch. The individual compressor stages are driven by means of pinion shafts, of which at least one shaft end, normally both shaft ends, project out of the gearing housing. The impellers of the individual compressor stages are attached, generally so as to be mounted in floating fashion, on the projecting-out shaft ends. Between the individual compressor stages of the geared compressor, the process fluid may be fed to other processes or may simply undergo cooling. Alternatively, the process fluid may also be transferred from one compressor stage directly to the next compressor stage by means of a connecting fluid line. In FIG. 1, an intercooler ICL between the two compressor stages CO21, CO22 of the second compressor CO2 is illustrated. After the compression in the second compressor CO2 of the second compressor train CT2, the process fluid PF is conducted to further processes PRO.

The compression in the first compressor train CT1 takes place with a pressure ratio between 1.1 and 1.6. The second compressor train CT2 compresses the process fluid PF to a final pressure of approximately 3 to 60 bar. The intake of the first compressor train CT1 occurs approximately under atmospheric conditions, wherein the process fluid is, in the present case, air. The use as an air compressor is the design type advantageous for the invention. The intake of the first compressor train CT1 occurs slightly below atmospheric pressure because the filter FIT arranged upstream causes a pressure loss.

Figure 2:
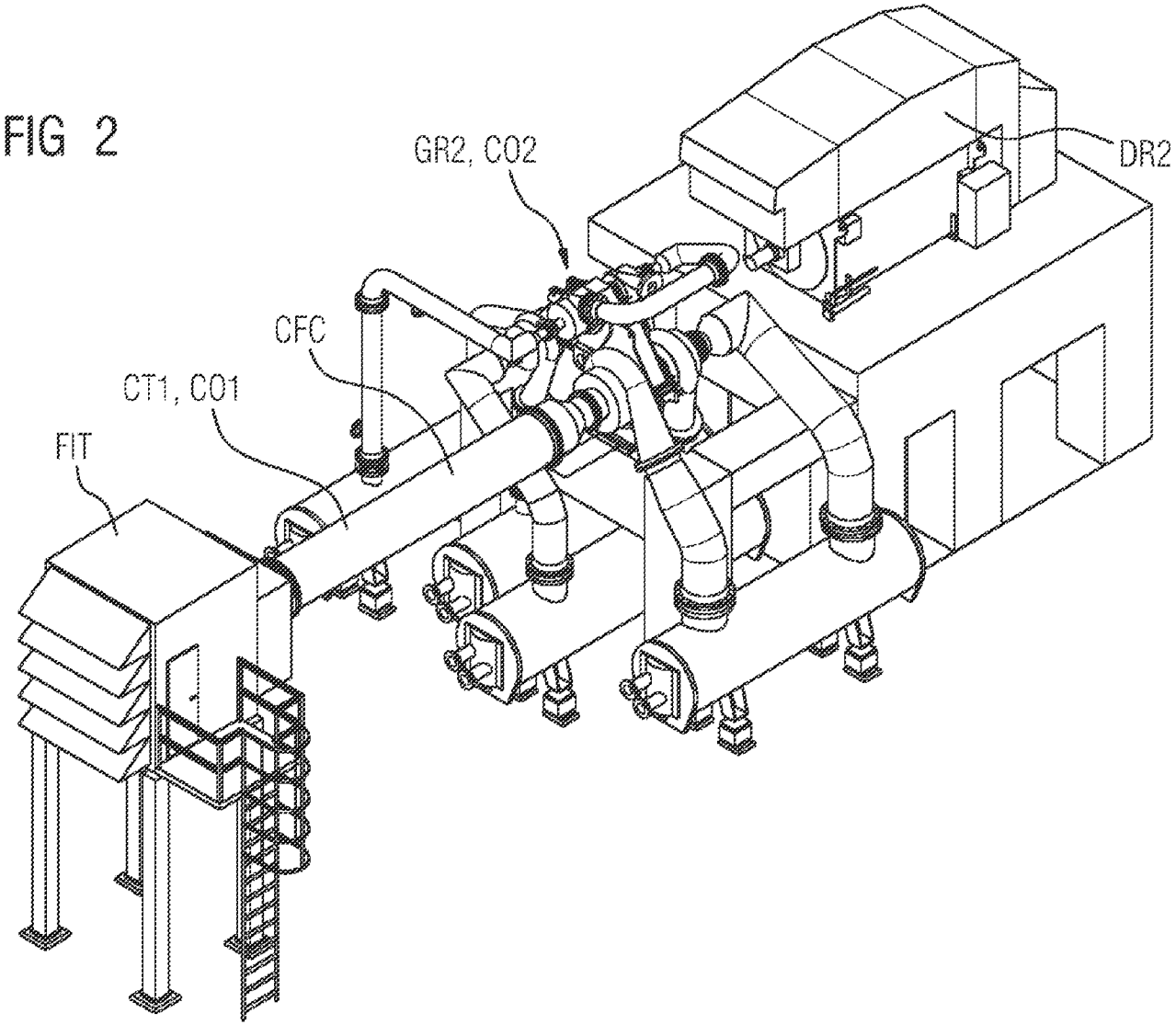
FIG. 2 is a three-dimensional schematic illustration of an arrangement according to the invention.
Figure 3:
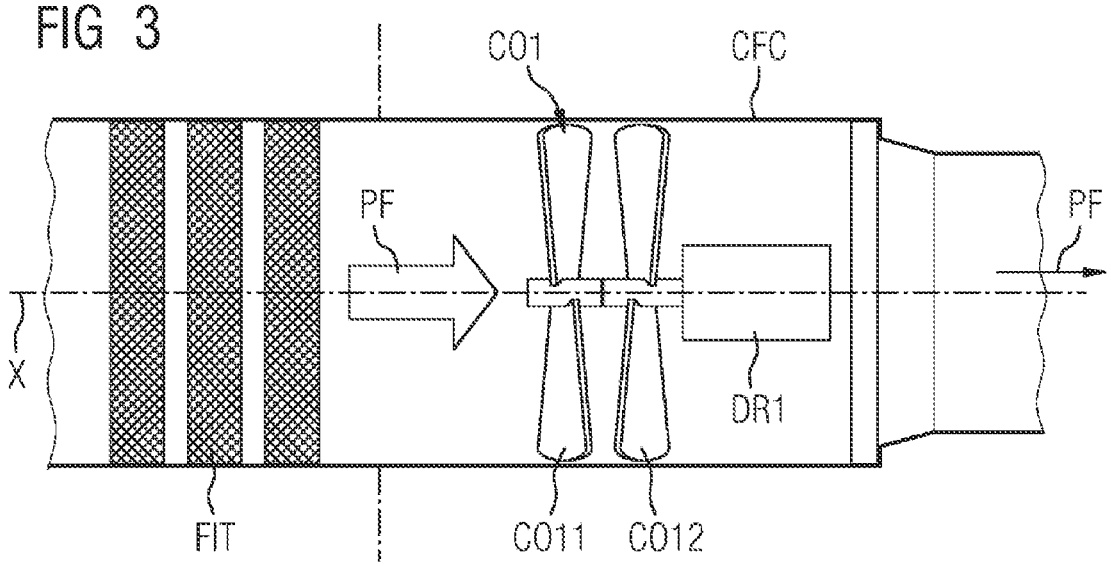
FIG. 3 shows a schematic depiction, in longitudinal section, of a combination of a filter with a first compressor train.
Figure 4:
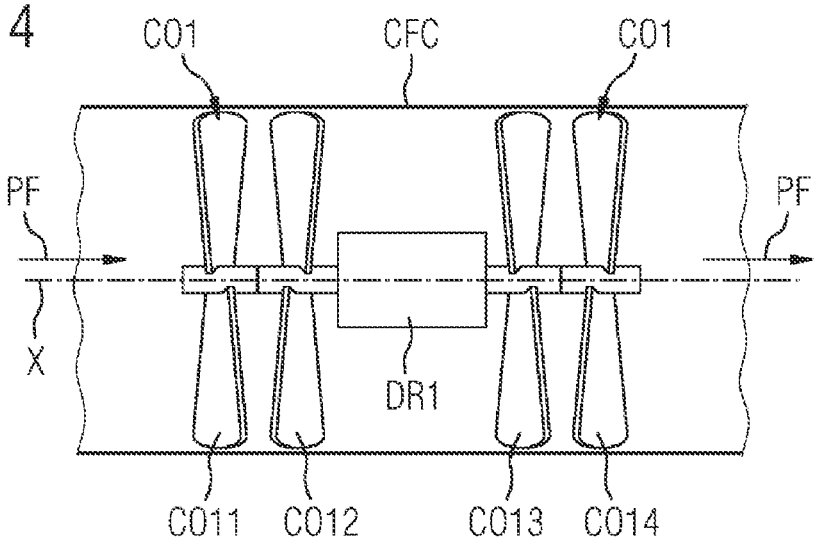
FIG. 4 shows another embodiment of a first compressor train.
Figure 5:
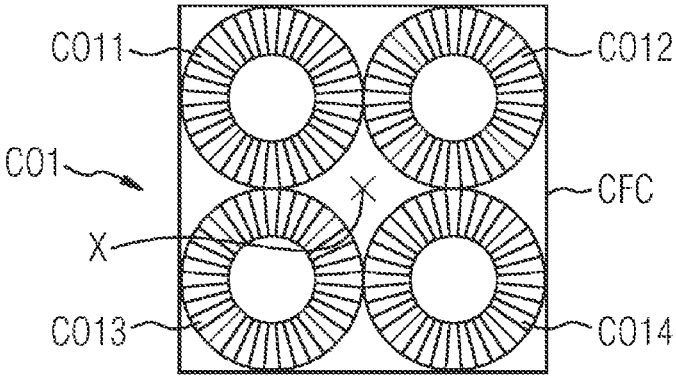
FIG. 5 is a schematic illustration, in cross section, of a first compressor train of modular design.

FIG. 2 shows a perspective illustration of a possible embodiment of the arrangement according to the invention. A filter FIT is arranged in a filter housing upstream of the first compressor train CT1. The first compressor train CT1 is integrated in the connecting fluid line CFC, which extends substantially from the filter FIT to the second compressor train CT2. Possible embodiments of such a first compressor CO1 or of the first compressor train CT1 are illustrated in FIGS. 3, 4 and 5. Illustrated downstream of the connecting fluid line CFC is a second compressor CO2, in the form of a geared compressor, of the second compressor train CT2. The second gearing of the geared compressor is denoted GR2, wherein the second gearing has, for each individual compressor stage, dedicated gearing components which are not individually designated here. The type of construction of said geared compressor corresponds to the above-described basic design of geared compressors. According to the invention, the second compressor is designed as a geared compressor. The second drive DR2 of the second compressor train CT2 is situated downstream of the second compressor CO2 in an axial elongation of the flow of the process fluid PF through the connecting fluid line CFC. The first drive DR1 of the first compressor train CT1 is integrated, in a manner which is not shown, in the connecting fluid line CFC.

Figure 7:
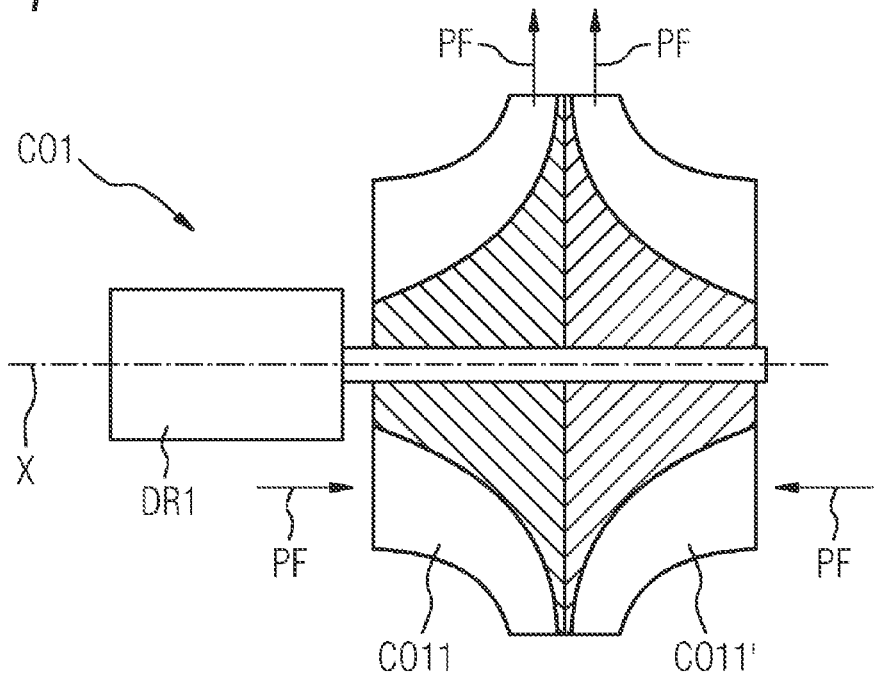
FIG. 7 is a schematic illustration of a first compressor train as a radial blower in longitudinal section through the first compressor.
Figure 8:
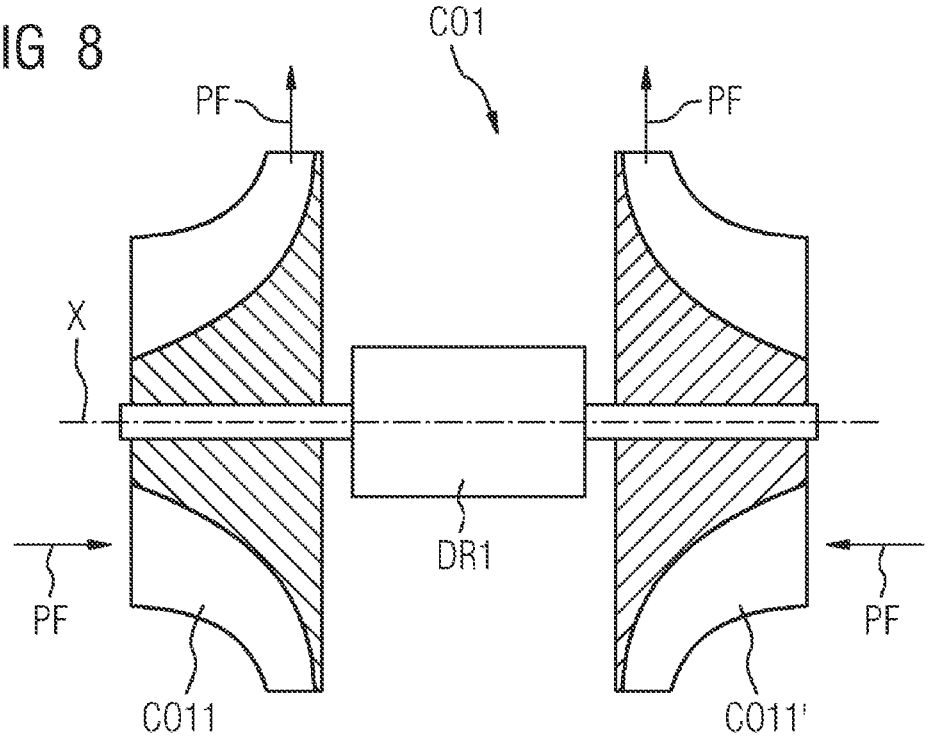
FIG. 8 shows an alternative embodiment in relation to the illustration of FIG. 7.

Such a type of construction of the integrated form of the first compressor train CT1 is illustrated in FIG. 3. Downstream of a filter FIT, the process fluid PF is raised to a higher pressure level by the first compressor train CT1, wherein both the first compressor CO1 and the first drive DR1 are integrated in the connecting fluid line CFC between the filter FIT and the downstream second compressor train CT2, which is not illustrated in any more detail. Here, the first compressor CO1 is in the form of an axial compressor. The two illustrated compressor stages CO11, CO12 of the first compressor CO1 may in this case be driven in opposite directions, with guide blades being omitted, wherein corresponding gearing measures for the drive are not illustrated here. The first drive DR1 may also be situated radially outside said axial blade arrangement. For the integral form of the first compressor CO1 in an elongation of the connecting fluid line or as an integral constituent part of the connecting fluid line CFC, the embodiment of the first compressor as an axial compressor is advantageous. An alternative embodiment of an axial compressor as first compressor CO1 is shown in FIG. 4, in which four compressor stages CO11, CO12, CO13, CO14 are arranged axially in series, in relation to an axis of rotation X which extends along the main flow direction of the process fluid PF. Said axis of rotation X is also depicted in FIG. 3. Whereas, in FIG. 3, the first drive DR1 is situated on one axial side of the overall first compressor CO1, it is the case in FIG. 4 that the first drive DR1 is arranged axially between compressor stages CO11 to CO14 situated upstream and downstream. This axial sequence has the advantage that the axis of the rotor does not project particularly far out of the drive DR1 and, in this way, the bearing arrangement within the motor is sufficient to control the rotor dynamics of the overall arrangement of the first compressor. FIGS. 7 and 8 show similar views with regard to the embodiment of the first compressor train CT1 or of the first compressor CO1 as a radial compressor.

Special modularity of the first compressor train CT1 is shown in FIG. 5. Here, the connecting fluid line CFC has been sectioned perpendicular to the axis X, and the individual compressor stages CO11 to CO14 are schematically shown. The cross section of the connecting fluid line CFC is divided into four segments, wherein one compressor stage CO11 to CO14 is arranged in each segment, such that a parallel rather than a series compressor stage arrangement is realized. In this way, relatively small blowers can be used adjacent to one another in order to precompress the process fluid PF before it enters the second compressor CO2.

Figure 6:
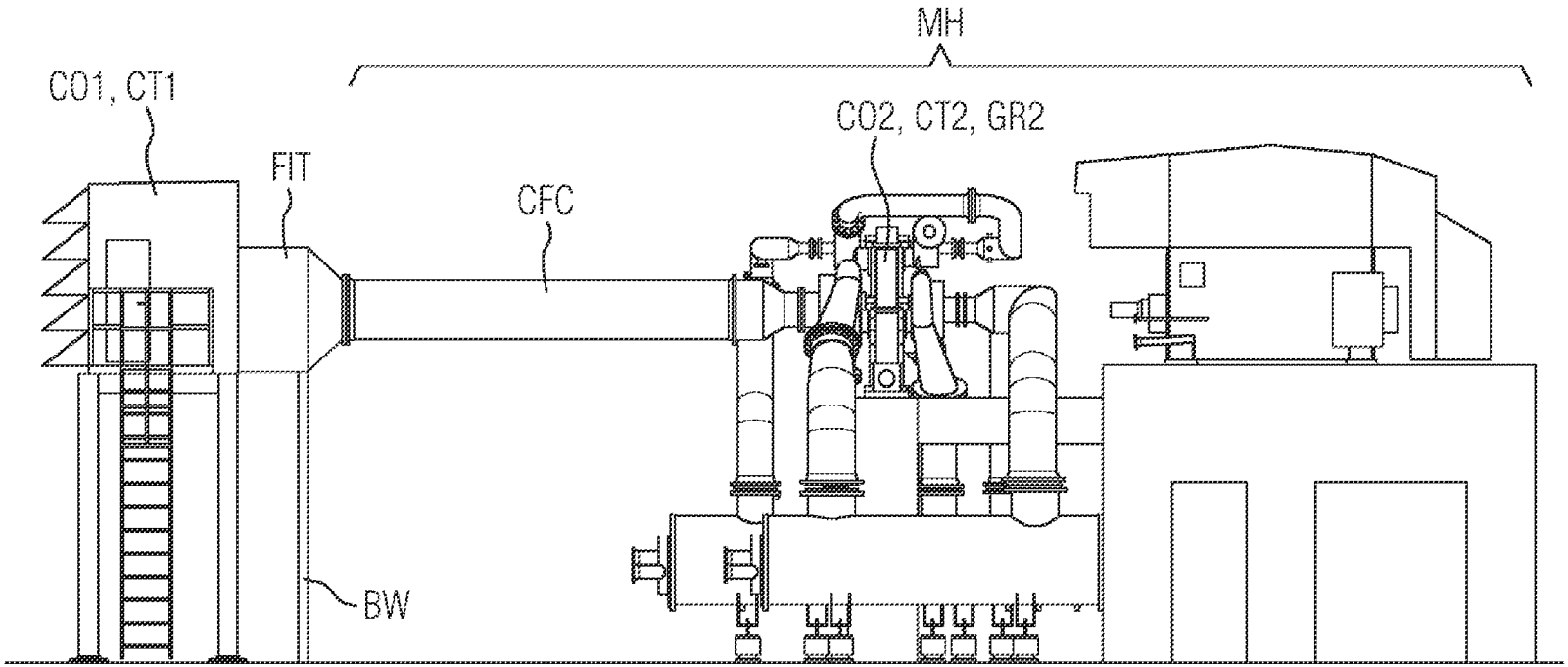
FIG. 6 shows a schematic longitudinal section through an arrangement according to the invention with a first compressor train, the first compressor of which is in the form of a radial blower.

FIG. 6 shows a schematic illustration of an arrangement according to the invention, wherein the first compressor CO1 of the first compressor train CT1 is in the form of a radial blower and compresses air, which has been taken in atmospherically, before said air enters the filter FIT. Here, the filter FIT and the first compressor CO1 are arranged outside a machine case for the second compressor train CT2, or on the outside of a case wall BW of the machine case MH. Here, the housing of the filter FIT is charged with an outlet pressure which is higher than the atmospheric pressure, and said housing must therefore be designed to be stronger than in the case of a situation with atmospheric intake. This is of significance in particular in the case of retrofitting of the first compressor train CT1, because it may be necessary for the entire filter FIT to be replaced with a strengthened model.

FIGS. 7 and 8 show a possible embodiment of the first compressor CO1 as illustrated in FIG. 6. Here, similarly to the axial compressors of FIGS. 3 and 4, it is the case in FIG. 7 that the first drive DR1 is arranged axially adjacent to the compressor stages CO11, CO11', and in FIG. 8, the first drive DR1 is situated axially between the two compressor stages CO11, CO11'. The difference in relation to the illustration of FIGS. 3 and 4 of the axial compressor lies substantially in the fact that the intake by the radial blower embodiment of FIGS. 7 and 8 occurs axially and the discharge thereof occurs radially, and in the fact that the radial compressor stages operate not in series with one another but in parallel.

Figure 9:
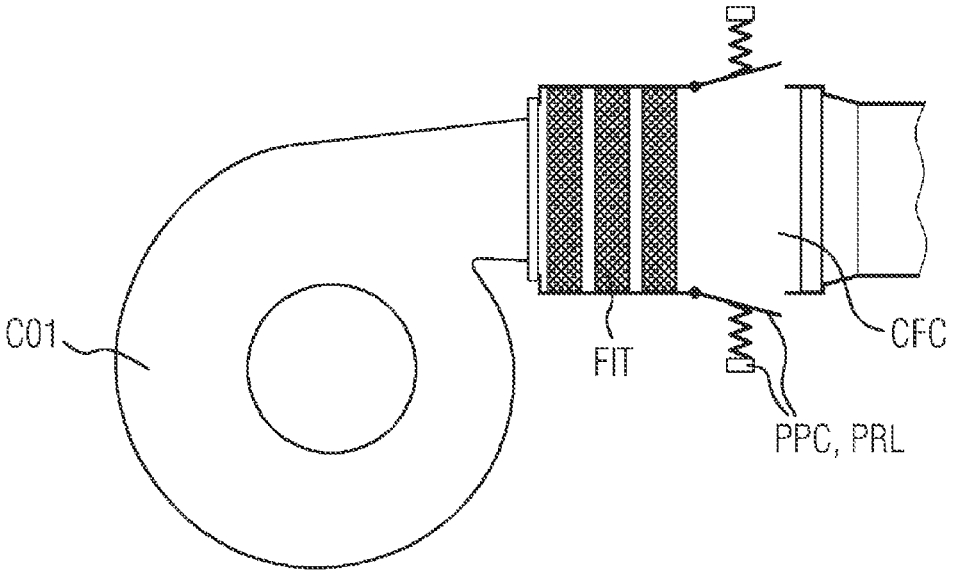
FIG. 9 shows an exemplary embodiment of a surging protection means downstream of a first compressor, in the form of a radial blower, with an attached filter.

FIGS. 9, 10, 11 and 12 are concerned with a surging protection device PPC for the arrangement. FIG. 9 shows the first compressor CO1 as a radial blower in an arrangement upstream of the filter FIT. The connecting fluid line CFC situated downstream is equipped with the surging protection device PPC. The surging protection device PPC is a pressure relief device PRL, wherein spring-preloaded flaps open in the presence of positive pressure in the connecting fluid line CFC. In this way, the radial blower of the first compressor CO1 is protected against surging shocks on the second compressor CO2 (not illustrated) situated downstream.

Figure 10:
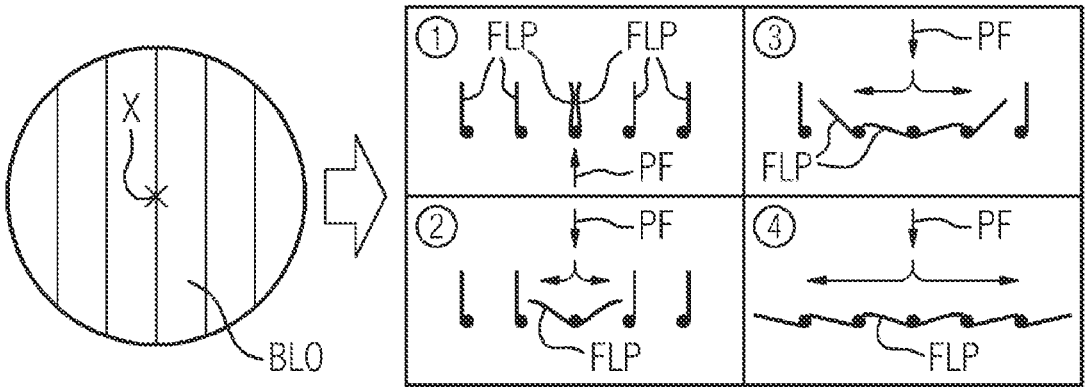
FIG. 10 shows a closing device of a surging protection means.

FIG. 10 shows a closing device BLO which may be provided in the connecting fluid line CFC in order to protect the first compressor CO1 against surging shocks from the second compressor CO2. Said closing device BLO may basically be a constituent part of any surging protection device PPC, or else may otherwise be provided as a non-return flap for preventing backflows. The closing device BLO is depicted, on the left in FIG. 10, in a view in an axial direction along an axis X. Here, the axis X corresponds to the main flow direction of the process fluid PF. The closing device BLO comprises multiple flaps which are arranged adjacent to one another in the manner of lamellae and which can close the flow cross section of the connecting fluid line CFC over at least 80% of the area. Here, a complete sealing action is not sought here, it rather being the intention for large pressure differences from pressure shocks to be prevented or shielded. In the action sequence depicted to the right of the cross-sectional illustration, multiple flaps FLP—viewed in the direction of their rotary spindles perpendicular to the main flow direction—are initially arranged adjacent to one another in an open position. A process fluid PF flows along the normal flow direction. In the event of a reversal of the flow direction—that is to say in the case of a backflow—of the process fluid PF, it is firstly the case that the central pair of flaps FLP closes as a result of the aerodynamic design of the flaps, in which the backflow becomes caught and thereby pushes the flaps FLP closed. Similarly to a domino effect, the adjacent flaps are also sequentially pivoted closed as a result of the pivoting-closed and/or the flow diversion of the flaps FLP that are pivoted closed first. In this way, in the fourth image of the sequential illustration, the entire closing device BLO is situated in a closed position. The flaps FLP are advantageously equipped with a damping arrangement which operates in one direction, such that surging shocks do not result in permanent opening and closing of the closing device BLO. The damped movement direction is in this case advantageously the movement into the open position.

Figure 11:
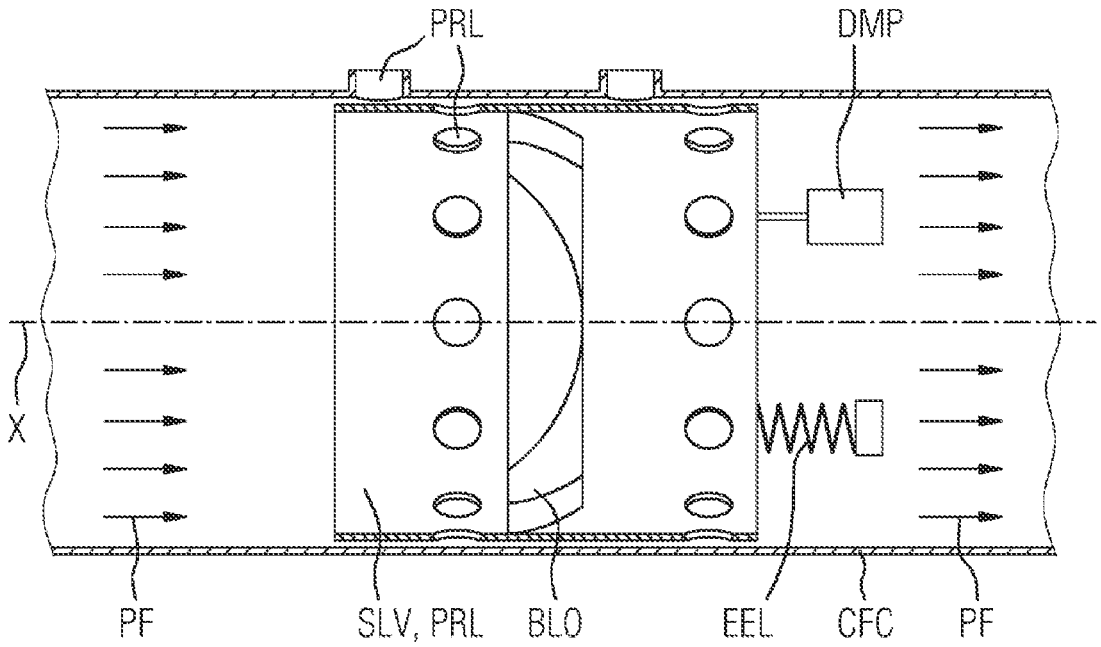
FIG. 11 shows a surging protection means, with a combined closing device and relief device in a first operating position in a closed position of the relief device.
Figure 12:
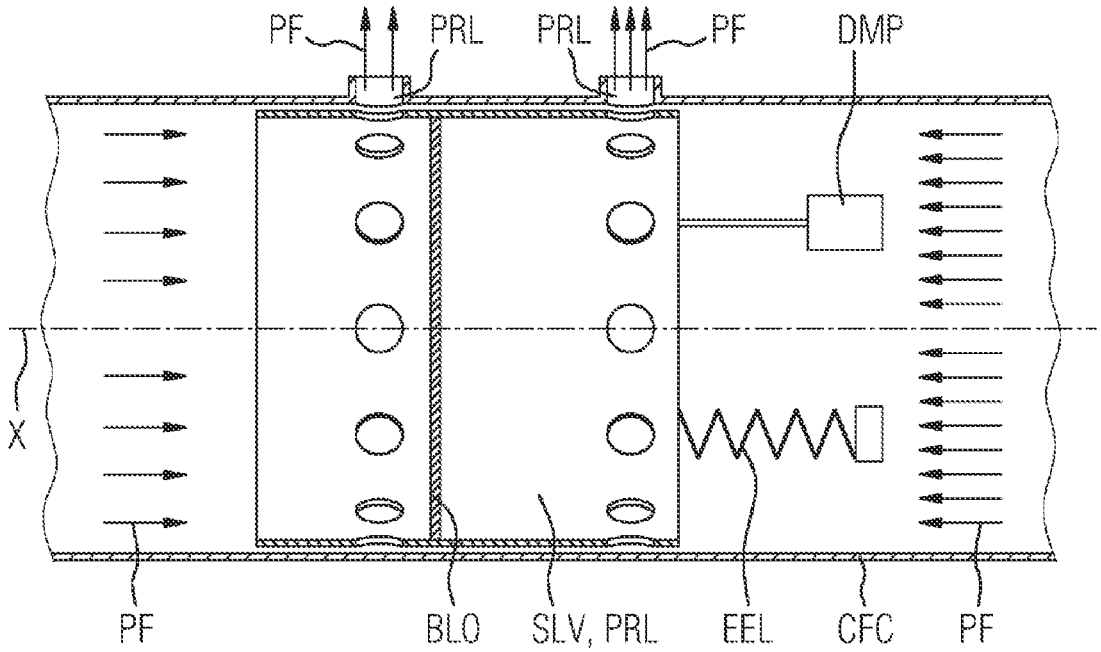
FIG. 12 shows the surging protection device as per FIG. 11 in a second operating position in an open position of the relief device.

FIGS. 11 and 12 show the embodiment of a surging protection device PPC which combines a closing device BLO and a pressure relief device PRL with one another. Here, in FIG. 11, the surging protection device PPC is situated in a normal open operating position, and in FIG. 12, said surging protection device PPC is situated in an operating position which is closed for the normal flow of the process fluid PF. Here, the connecting fluid line CFC is equipped with a slide valve SLV which is axially displaceable in the direction of an axis X. Said slide valve SLV is a constituent part of the pressure relief device PRL. Fixedly connected to the slide valve SLV is the closing device BLO, which, in the presence of an axial backflow of the process fluid PF, closes the flow cross section of the connecting fluid line CFC over at least 80% of the area. Counter to the force of a restoring spring EEL and of a damper DMP, the differential pressure of the process fluid PF across the closing device BLO, which seeks to flow backward, drives the slide valve SLV into an axial position in which a radial outlet of the pressure relief device PRL is open both upstream and downstream of the closing device BLO, such that the process fluid PF is relieved of pressure. In this way, the first compressor train CT1 and the second compressor train CT2 are protected, both upstream and downstream of the surging protection device PPC, against surging shocks.

The invention claimed is:

1. An arrangement comprising:

a first compressor train and a second compressor train for compressing a process fluid, wherein the first compressor train comprises a first drive and a first compressor, wherein the second compressor train comprises a second drive and a second compressor, wherein the first compressor train is not mechanically coupled in torque-transmitting fashion to rotating parts of the second compressor train, wherein the first compressor and the second compressor are directly connected in fluid-conducting fashion to one another by means of a connecting fluid line, in such a way that the first compressor is arranged upstream of the second compressor, wherein the first compressor compresses with a pressure ratio between 1.1 and 1.6 before the process fluid is fed to the second compressor, wherein the second compressor is in the form of a geared compressor comprising a gearing housing on the outside of which are mounted plural spiral housings of respective radial compressor stages, wherein the respective radial compressor stages are arranged sequentially with respect to compressed air flowing therethrough, and wherein the second compressor is a constituent part of a gas turbine and supplies the compressed air to a turbine of the gas turbine.

2. The arrangement as claimed in claim 1, wherein the second compressor compresses with a pressure ratio between 3 and 60 while the first compressor compresses with the pressure ratio between 1.1 and 1.6.

3. The arrangement as claimed in claim 1, wherein the first drive is either a second gas turbine or a steam turbine or an electric motor.

4. The arrangement as claimed in claim 1, wherein the second compressor compresses with a pressure ratio that is at least 3.8 times higher than the pressure ratio of the first compressor.

5. The arrangement as claimed in claim 1, wherein the first compressor comprises a fan or a blower.

6. The arrangement as claimed in claim 1, wherein the first compressor comprises at least one first compressor stage and second compressor stage, and wherein the first drive is arranged between the at least one first compressor stage and the second compressor stage.

7. The arrangement as claimed in claim 1, wherein the first compressor is in the form of an at least two-stage radial compressor comprising a first compressor stage and a second compressor stage, wherein the first compressor stage and the second compressor stage each comprise an intake side and a wheel disk side, and wherein a wheel disk side of the first compressor stage faces axially toward a wheel disk side of the second compressor stage, and wherein intake of the first compressor stage and the second compressor stage occurs in axially opposite directions.

8. The arrangement as claimed in claim 7, wherein the first drive is arranged axially between the wheel disk side of the first compressor stage and the wheel disk side of the second compressor stage.

9. The arrangement as claimed in claim 1, wherein the first compressor train is arranged upstream of a filter and the process fluid is conducted into the second compressor only after passing through the filter.

10. The arrangement as claimed in claim 1, wherein a filter is arranged upstream of the first compressor, and the process fluid is conducted directly from the first compressor into the second compressor without passing the filter.

11. The arrangement as claimed in claim 1, wherein at least one surging protection device is provided between the first compressor and the second compressor, wherein the at least one surging protection device comprises a closing device, and wherein, in the event of surging, the closing device closes at least 80% of a flow cross section of the connecting fluid line between the first compressor and the second compressor.

12. The arrangement as claimed in claim 1, wherein at least one surging protection device is provided between the first compressor and the second compressor, wherein the at least one surging protection device comprises a pressure relief device which, in the event of surging of the first compressor and/or of the second compressor, relieves the connecting fluid line between the first compressor and the second compressor, or at least a section of the connecting fluid line between the first compressor and the second compressor, of pressure and/or pressure shocks through an opening and into a pressure sink.

13. The arrangement as claimed in claim 11, wherein the first compressor is an axial compressor.

14. The arrangement as claimed in claim 1, wherein the first compressor is in the form of a radial compressor and no surging protection device is provided upstream of the second compressor.

15. The arrangement as claimed in claim 11, wherein the closing device is designed such that, in the event of a backflow of the process fluid from the second compressor train to the first compressor train, the closing device, driven by the back-flowing process fluid, blocks the connecting fluid line over at least 80% of the flow cross section.

16. The arrangement as claimed in claim 11, wherein the closing device is connected to a slide valve and a mechanical thrust arising from a reverse differential pressure across the closing device moves the slide valve into an opening position, such that the connecting fluid line between the first compressor train and the second compressor train is thereby connected to a pressure sink, such that a release of pressure from the connecting fluid line occurs.

17. A method for retrofitting and/or adding a first compressor train to a second compressor train of an existing installation, the method comprising: providing the first compressor train and the second compressor train for compressing a process fluid, wherein the first compressor train comprises a first drive and a first compressor, wherein the second compressor train comprises a second drive and a second compressor, wherein the first compressor train is not mechanically coupled in torque-transmitting fashion to rotating parts of the second compressor train, directly connecting the first compressor and the second compressor in fluid-conducting fashion to one another by means of a connecting fluid line, in such a way that the first compressor is arranged upstream of the second compressor, wherein the first compressor compresses with a pressure ratio between 1.1 and 1.6 before the process fluid is fed to the second compressor, wherein the second compressor is in the form of a geared compressor comprising a gearing housing on the outside of which are mounted plural spiral housings of respective radial compressor stages, wherein the respective radial compressor stages are arranged sequentially with respect to compressed air flowing therethrough, wherein the second compressor is a constituent part of a gas turbine and supplies the compressed air to a turbine of the gas turbine.

18. The method as claimed in claim 17, wherein, in a step of the retrofitting, the second compressor is aerodynamically modified such that a pressure ratio of the second compressor is reduced in relation to a state before the retrofitting.

* * * * *